US005265553A

United States Patent [19]

Brydges

[11] Patent Number: 5,265,553

[45] Date of Patent: Nov. 30, 1993

[54] SMALL BOAT MOORING SYSTEM

[75] Inventor: Hugh B. Brydges, Virginia Beach, Va.

[73] Assignee: Sea-Safe, Inc., Virginia Beach, Va.

[21] Appl. No.: 804,113

[22] Filed: Dec. 6, 1991

[51] Int. Cl.[5] ..... B63B 21/04

[52] U.S. Cl. ..... 114/230; 114/293

[58] Field of Search ..... 114/230, 293

[56] References Cited

U.S. PATENT DOCUMENTS

| | | | |
|---|---|---|---|
| 2,440,972 | 5/1948 | Peltier | 114/230 |
| 2,552,424 | 5/1951 | Gorman | 114/230 |
| 3,060,884 | 10/1962 | Wood | 114/230 |
| 3,108,563 | 10/1963 | Wurdack | 114/230 |
| 3,183,877 | 5/1965 | Benzel | 114/230 |
| 3,406,651 | 10/1968 | Jalbert | 114/230 |
| 3,462,960 | 8/1969 | Bruehl | 61/48 |
| 3,464,214 | 9/1969 | King | 61/48 |
| 3,695,209 | 10/1972 | Giese | 114/230 |
| 3,842,779 | 10/1974 | Jaynes | 114/230 |
| 3,971,329 | 7/1976 | Kosmatka | 114/230 |
| 4,280,440 | 7/1981 | Barton | 114/230 |
| 4,284,026 | 8/1981 | Martinson et al. | 114/230 |
| 4,309,954 | 1/1982 | Szuch | 114/230 |
| 4,480,576 | 11/1984 | Mills | 114/230 |
| 4,735,164 | 4/1988 | Burg | 114/67 A |

*Primary Examiner*—Sherman D. Basinger
*Attorney, Agent, or Firm*—Joseph G. Seeber

[57] ABSTRACT

A small boat mooring system is provided for securing a boat to a dock, pier or pilings in such a way that the boat is free to move vertically with the normal changes in tide or wave action. The system comprises a plurality of nylon lines, a snaphook for connecting each line to the boat, a counterweight connected to the other end of each line, and hardware mounted on each of a plurality of pilings. The hardware comprises a steel plate section, a lag eye, a quick link, and a pulley connected thereto for conveying the nylon line through the hardware. The system of the present invention permits vertical movement of the boat, such as that caused by rise and fall of tides or rolling of the boat, while maintaining the boat centered in the slip and away from an associated dock, pier or piling. The system further redistributes or absorbs energy produced by the action of water, wind and other conditions on the boat. The mooring system may be quickly assembled and disassembled, and has the advantage of converting a slip normally used for larger boats into a slip which can accommodate a smaller boat.

15 Claims, 4 Drawing Sheets

SMALL BOAT MOORING SYSTEM

DESCRIPTION

1. Technical Field

This invention relates to a small boat mooring system and, more specifically, to a system for securing a boat to a dock, pier, or pilings in such a way that the boat is free to move vertically with the normal changes in tide or wave action.

2. Background Art

Many people who live on the water have docks and piers which were (and are) built for large boats in the 50 to 70 foot range. In this situation, the positioning of the outboard pilings (used for line attachment to hold the boats off the dock so they stay somewhat in the middle of the slip) is usually 15 to 20 feet away from the pier. This is fine for larger boats. However, with the increased price of gas, and the high cost of service and maintenance, most of these same people have a 15 to 25 foot runabout or small pleasure craft.

In the latter respect, there is a need in the prior art for a system which converts the large type of slip and makes it much more accommodating for the smaller type of water craft. Specifically, there is need for a system which causes a boat to act as if it is at a floating dock, thereby eliminating the need for constant monitoring of the line length vis-a-vis the height of the tide. Additionally, there is need in the prior art for a small boat mooring system which will make it unnecessary for the boat handler to leave the craft in order to secure or resecure the boat to the system. Finally, there is need in the prior art for a small boat mooring system which, when used with a lift system, stays attached to the boat as the boat is lifted out of the water so that, when the boat is then lowered into the water, the boat is still attached to the system and stays in the middle of the slip until ready for use, thereby precluding any necessity on the part of the boat handler to immediately jump on board the boat, grab the lines, and secure them to keep the boat from floating away from the boat lifting system.

The following patents are representative of the prior art relative to the invention disclosed herein: U.S. Pat. Nos. 3,108,563; 3,406,651; 3,462,960; 3,464,214; 3,695,209; 3,971,329; 4,280,440; 4,284,026; 4,309,954; 4,735,164; and 4,480,576.

DISCLOSURE OF INVENTION

The present invention relates to a small boat mooring system and, more specifically, to a system for securing a boat to a dock, pier or pilings in such a way that the boat is free to move vertically with the normal changes in tide or wave action.

In particular, the system of the present invention is especially useful for converting a large slip, usually used to accommodate a large boat, into a slip in which a small boat is easily accommodated. In short, the system of the present invention functions in such a way that the boat moored by the system acts as if it is a floating dock, eliminating the need for constant monitoring of line length vis-a-vis height of the tide. In addition, the system is such that there is no need to leave the boat in order to secure or resecure the boat to the system. Thus, many of the problems inherent in mooring systems of the prior art are eliminated by the present invention.

An additional use for the system of the present invention is found in small boat lift systems, such lift systems being installed on many waterfront docks. This additional use is realized in that the present invention eliminates the need for unsightly polyvinylchloride (PVC) pipes which are normally used as guides to position the boat over a lift cradle in conventional small boat lift systems. In accordance with the present invention, the mooring system thereof stays attached to the boat as it is lifted out of the water. Then, when the boat is lowered with the mooring system intact, the boat stays in the middle of the slip, centered over the lift cradle of the lift system, until ready for use. There is no need for the boat handler to jump on board the boat, grab the lines, and secure them to keep the boat from floating away from the lift system.

Thus, the present invention provides an automatically adjusting boat mooring system for small boat mooring at a conventional dock, either fixed or floating, or at a pier which has been set up for larger craft. An important feature of the present invention resides in the provision of special in-piling hardware which is mounted on the pilings located at the mooring sight. The hardware mounted on each piling includes a pulley which accommodates a corresponding mooring line connected at one end to the boat and having a counterweight connected to the other end. When each set of system hardware and its accompanying line and counterweight have been adjusted to proper length and fixed in place, the boat automatically remains situated in the middle of the slip.

Therefore, it is a primary object of the present invention to provide an improved mooring system or structure for the docking or mooring of small boats or waterborne vessels.

It is an additional object of the present invention to provide a self-adjusting and resilient small boat mooring system for use in situations where water levels vary.

It is an additional object of the present invention to provide an improved type of mooring hardware, easily disassembled for winterizing or for accommodation of a larger craft in the slip.

It is an additional object of the present invention to provide an improved small boat mooring system that is automatically self-adjusting and eliminates the need for constant monitoring of tide height vis-a-vis the line length of the boat, as is necessary in manually adjustable systems.

It is an additional object of the present invention to provide an inexpensive and yet highly durable, rugged and maintenance-free mooring system by utilization of zinc, galvanized metal and plastic PVC parts.

It is an additional object of the present invention to provide a space-efficient mooring system which is least likely to cause or allow damage to the boat.

The above and other objects of the invention, as will hereinafter appear, and the nature of the invention will be more clearly understood by reference to the following detailed description, the accompanying drawings and the appended claims.

BRIEF DESCRIPTION OF DRAWING FIGURES

BEST MODE FOR CARRYING OUT THE INVENTION

The invention will now be described in more detail with reference to the accompanying drawings.

Figure 1:
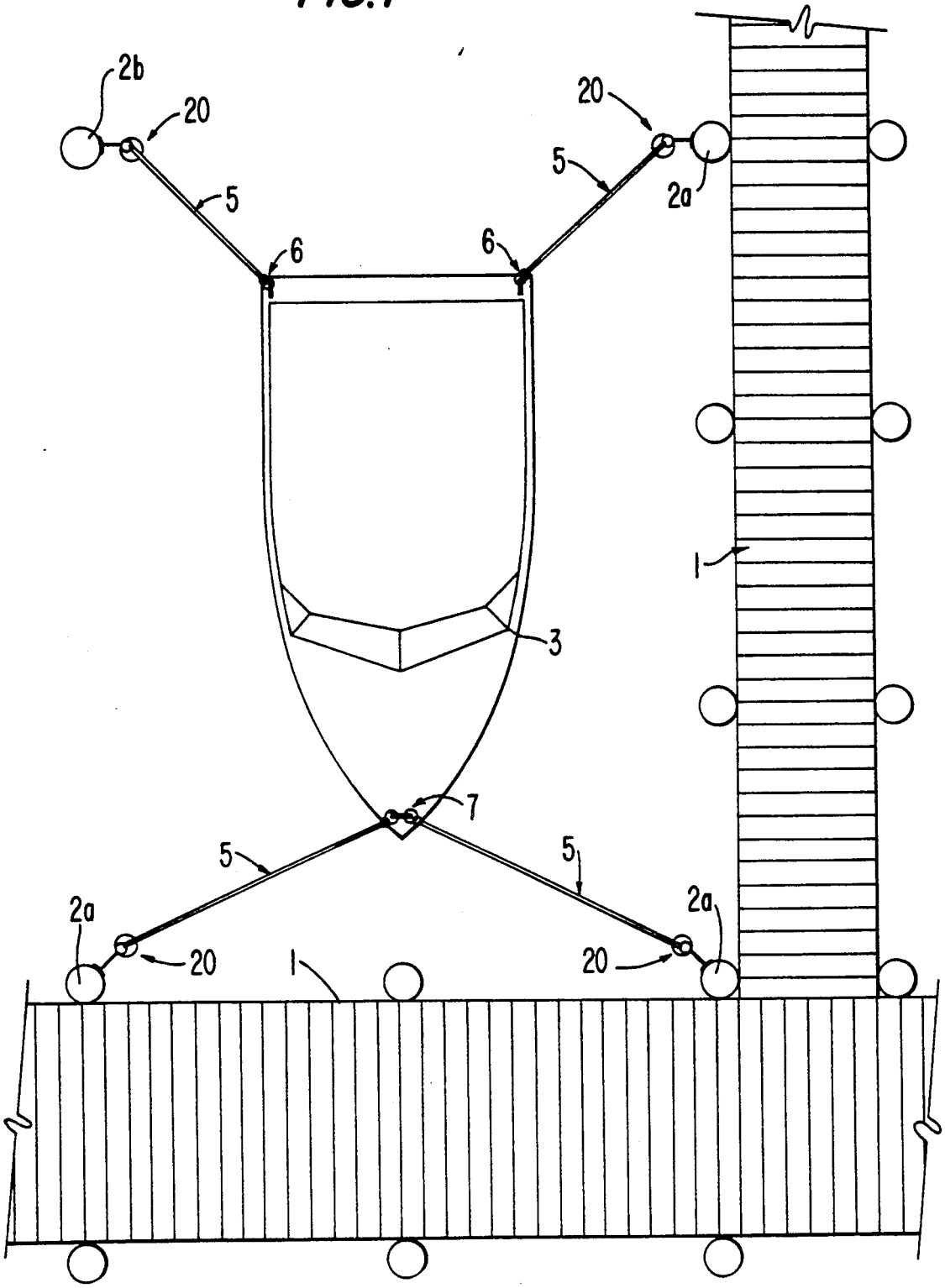
FIG. 1 is a plan view of a boat moored in accordance with the mooring system of the present invention.
Figure 2:
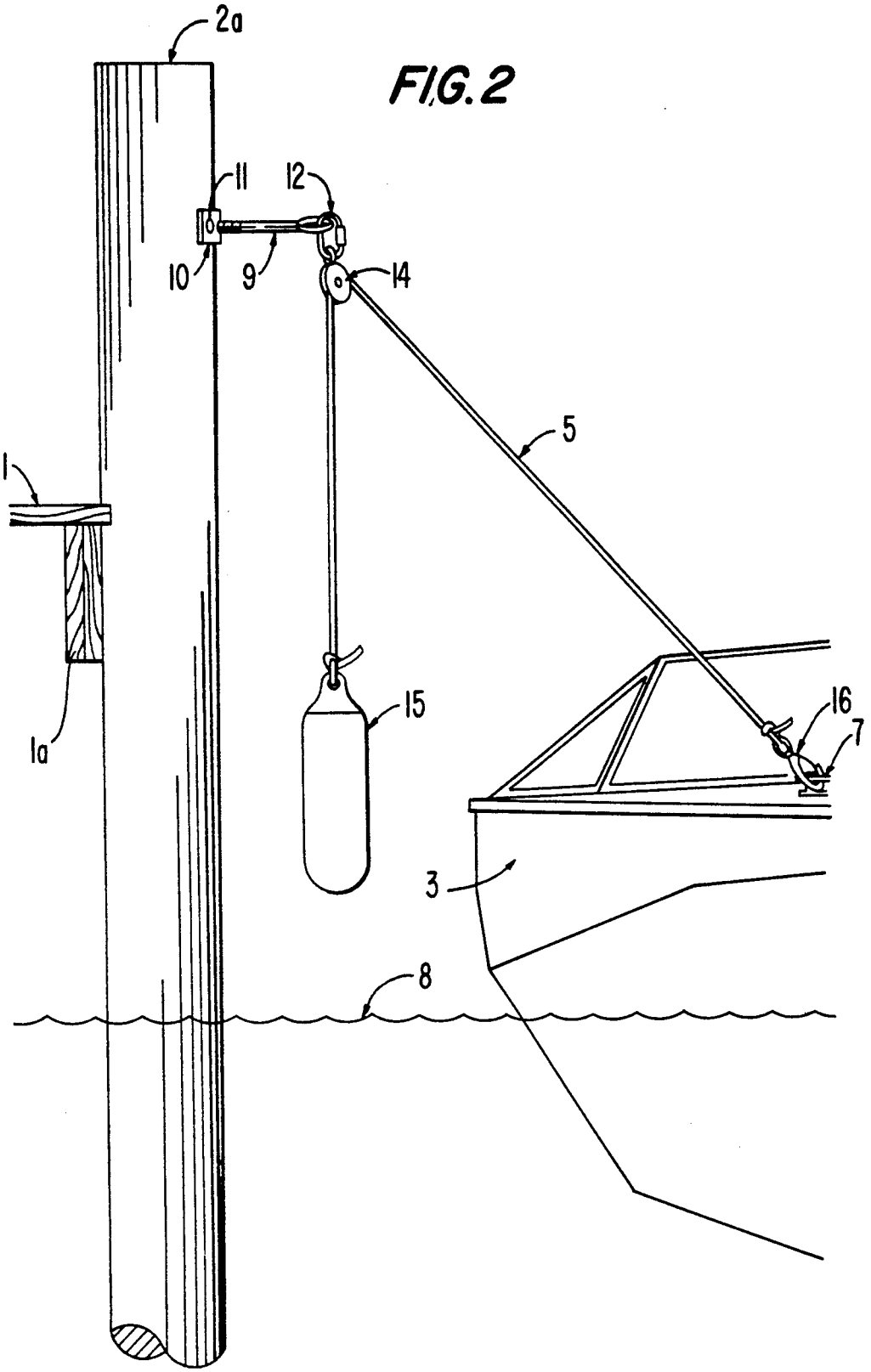
FIG. 2 is a side view of a boat moored to one of a plurality of fixed points in accordance with the mooring system of the present invention.

FIG. 1 is a plan view of a boat moored in accordance with the mooring system of the present invention, while FIG. 2 is a side view of a boat moored to one of a plurality of pilings in accordance with the system of the present invention.

More specifically, FIG. 1 shows a conventional boat dock or pier 1 (with catwalk) extending in both longitudinal and latitudinal directions, the dock 1 being supported by a plurality of vertically extending support pilings 2*a* which are of a generally conventional wooden construction. The pilings 2*a*, as well as outboard piling 2*b*, are driven into the surface of the earth below the water surface 8 so as to provide rigid support for the dock 1.

Further referring to FIGS. 1 and 2, the horizontal portion of the dock 1 is attached or fixed by a joist system 1*a* (see FIG. 2) to the inner and outer portions of pilings 2*a*. It should be noted that the mooring system of the present invention can be used with a "floating dock" arrangement as well. In the case of a fixed dock, the inner or land end of the dock 1 is usually fixed in some integral fashion to the land so that there is continuity between the land and dock 1. Thus, the dock pictured in FIGS. 1 and 2 is of a conventional arrangement.

Pilings 2*a* and 2*b* are generally shown as cylindrically shaped. However, it is not essential or critical that that particular configuration be used. For example, rectangular shaped pilings may be readily used with the system of the present invention.

The relative vertical positioning of the support pilings 2*a* and the outboard piling 2*b* is such that the upper ends thereof generally extend above the surface 8 of the water, as shown in FIG. 2. Additionally, the relative positioning and height of the support pilings 2*a* and outboard piling 2*b* vis-a-vis adjoining dock 1 is usually determined by the average water level at the pier, the height of the boat's gunnels above the water surface 8, and the generally experienced water level fluctuation at the location of the dock 1. It is in the situation where dock and pier configurations have been constructed for larger vessels that the need for the system of the present invention was first realized.

Docks and piers which can accommodate larger sized boats are usually found in water bodies contiguous to salt water, where tidal ebbs and flows are the rule. When constructing docks and piers for the creation of mooring areas for larger boats, the vertical positioning of both the support pilings 2*a* and outboard pilings 2*b* is governed by different parameters and considerations than in waterways frequented by smaller craft or in areas surrounding non-tidal bodies of water. The present invention was developed in order to satisfy a need for converting large docks or slips, normally used by larger boats, to the type of slips or docks that can accommodate smaller boats with minimum need for personal attention to line adjustment. Nevertheless, the system of the present invention also has applicability to smaller and narrower docking arrangements, including those containing small boat lifts. Where docks, floating docks or piers are constructed for smaller boats, the mooring system of the present invention eliminates the need to readjust the mooring lines constantly, and also eliminates the need for tying and untying of mooring lines when raising or lowering the boat.

Further referring to FIGS. 1 and 2, the mooring system of the present invention comprises conventional nylon lines 5 extending from points 6 on the stern of the boat and point 7 on the bow of the boat to respective pilings 2*a* and 2*b*, a snap hook 16 connected to the "boat" end of each nylon line 5, a PVC counterweight 15 connected to the other end of each nylon line 5, and in-piling hardware 20 located at and mounted on each of pilings 2*a* and 2*b* for conveying the nylon line 5 past the pilings 2*a* and 2*b*, respectively.

In the latter regard, it will be appreciated that, for proper installation of the system of the present invention, the pilings 2*a* and 2*b* to which hardware 20 is connected or attached must extend, as shown in FIG. 2, higher than the dock or pier 1. The outboard piling 2*b*, set away from the pier, must be of the same or similar height to the support pilings 2*a*. It should also be noted that, in FIG. 1, a smaller boat 3 is depicted as being moored in a slip which would normally be occupied by a much larger vessel, and thus outboard piling 2*b* is positioned quite a distance away from the dock 1 in accordance with the anticipated maximum boat size for the tidal region or waterfront area in question.

In addition, it should be noted that the description set forth herein is directed to a full implementation of the mooring system, utilizing four pilings 2*a* and 2*b*, as shown in FIG. 1. However, a half-implementation of the mooring system, utilizing only two pilings, may be used with respect to outboard pilings only, particularly in the situation involving a floating dock as contrasted with a conventionally constructed fixed dock.

Finally, it should be understood that each of the support pilings used with the mooring system will have mounted to it identical in-piling hardware 20, the proper installation procedures and line configuration associated with each in-piling hardware 20 being identical. Accordingly, it is only necessary to describe the operation of a single in-piling hardware 20, as depicted in FIG. 2.

Figure 3:
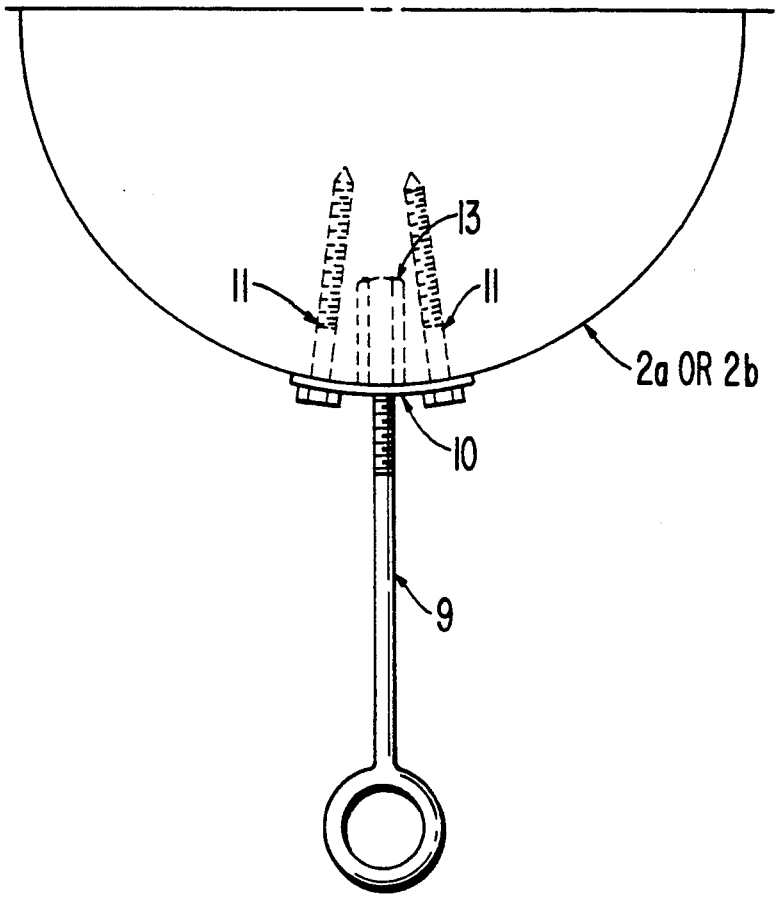
FIG. 3 is a top view of a piling in which the in-piling hardware of the present invention is mounted.
Figure 4A:
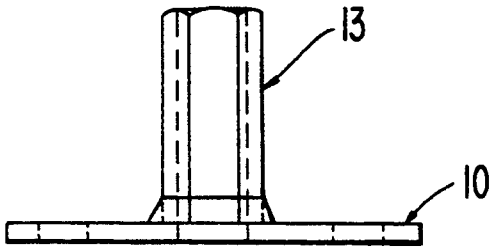
FIGS. 4A, 4B and 4C are top, plan and side views, respectively, of the steel plate of the hardware of the present invention.
Figure 4B:
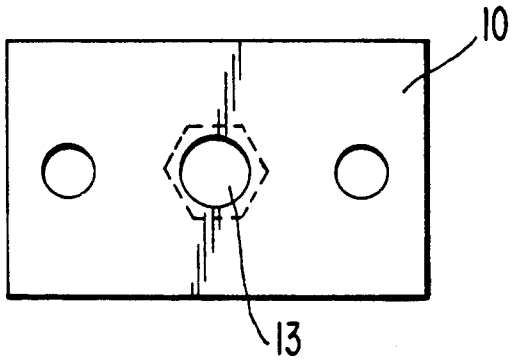
Figure 4C:
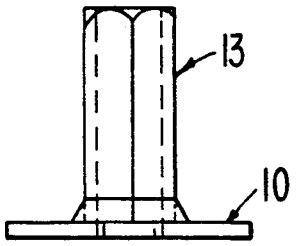

Referring to FIGS. 2, 3 and 4A thru 4C, in-piling hardware 20 is seen to comprise a lag eye 9 which is mounted on or in a steel plate section 10, the steel plate section 10 being mounted on piling 2*a* via lag screws 11. Hardware 20 further comprises a quick link 12 connected to the "eye" portion of lag eye 9, and a swivel pulley 14 connected to link 12. As best shown in FIGS. 2 and 3, both the "eye" portion of lag eye 9 and the quick link 12 are loop-like.

As further indicated in FIGS. 3 and 4A thru 4C, the hardware 20 is fabricated by cutting a 0.10 Ga. steel plate into sections, each of approximately 3.5 inches by 2 inches in dimensions, and then drilling a hole (preferably, ½ inch in diameter) in the center of the steel plate section 10, and two further holes (preferably, ⅜ inch diameter) in respective end portions of the section 10. Then, by conventional means (for example, welding), a coupling nut (preferably, ½ inch) is attached over the center hole of plate 10.

Hardware 20 is mounted onto piling 2*a* or 2*b* by drilling a hole (preferably, ¾ inch in diameter) in the piling 2*a* or 2*b* to a depth of approximately 2 inches. The hardware 20, and specifically steel plate section 10, is then secured tightly to the piling 2*a* or 2*b* by means of lag screws 11 (preferably, 4-inch hex head lag screws)

with corresponding washers (not shown). Thus, once mounted, steel plate section 10 stays permanently fixed to the piling *2a* or *2b* so that, if the remaining portion of hardware 20 is removed or dismantled temporarily, it can subsequently be reassembled and reinstalled very quickly and easily.

By way of further describing the installation of hardware 20, once the steel plate section 10 is mounted on piling *2a* or *2b*, as shown in FIG. 3, lag eye 9 is screwed into the coupling nut 13 until snug. Then, referring to FIG. 2, quick link 12 (preferably, made of zinc) is connected in a conventional manner to the "eye" portion of lag eye 9, and swivel pulley 14 (preferably, of aluminum) is also connected to the quick link 12. As indicated above and as shown in FIG. 2, quick link 12 is any conventional device capable of being quickly and easily opened for installation and linkage with the "eye" portion of lag eye 9 and the "ring" portion of pulley 14, and then quickly and easily capable of being closed and securely locked so as to provide a reliable linkage between the "eye" portion of lag eye 9 and the pulley 14.

Nylon line 5 (preferably, of the ⅜ inch variety) is run thru pulley 14, and is connected on one end to a specially designed PVC counterweight 15 (preferably, eighteen inches high and five inches in diameter). As a further preference, counterweight 15 has a special opening (not shown) which permits it to be filled with sand to any desired weight, so that the downward force exerted on nylon line 5 can be varied in accordance with the size of the boat and activity of the water in the particular location.

As indicated above, the other end of nylon line 5 is provided with a galvanized snap hook 16 which connects the line 5 to points 6 on the stern of the boat or a point 7 on the bow of the boat (depending on the owners preference of how he wishes to position the bow or stern in reference to the dock 1).

The placement of the in-piling hardware 20 is determined by finding the proper vertical distance up the piling *2a* or *2b* and above the gunnels of the boat 3 at mean high tide. This distance with respect to the gunnels of the boat is correct when the angles formed by the lines 5 (see FIG. 2) and created by each line 5 feeding around its respective pulley 14 from its corresponding counterweight 15 to its respective snaphook 16 achieves an acute angle of approximately 45°.

As further shown in FIG. 1, when the system of the present invention is installed with respect to all pilings *2a* and *2b*, then an engineered "cradle" effect is created by the angles working both for and against each other. That is, the pilings on the right side of the boat 3 work together as a team in competition with the pilings on the left side of the boat 3, thereby keeping the boat 3 centered in the middle of the slip. Thus, the subject invention operates on a simple principle of mathematics or physics in accordance with the unique system of pulley movement. As the water levels rise, the boat 3 will rise, and therefore the counterweights 15 will be lowered. Conversely, as the boat falls with the tide, counterweights 15 will rise, keeping steady tension on lines 5 at all times.

It should be further noted that it is desirable, in installing the preferred embodiment of the system of the present invention, to have more than one vertical support system with its attendant hardware-pulley combination. In the preferred embodiment, four such vertical systems (pilings *2a* and *2b* in FIG. 1) are employed around the boat 3. The embodiment depicted in FIG. 1 shows three support pilings *2a* being used in combination with an outboard piling *2b*. The system could just as easily be employed with two pilings located on a pier side of a boat and two other pilings located on the outboard side of the boat. With identical hardware 20 being deployed on all four pilings, the two pilings which sit behind the boat can be used to moor the boat using the stern or rear area hardware on the boat, while the other two pilings sitting forward of the boat can be used to moor the boat using the bow or front hardware.

While preferred forms and arrangements have been shown in illustrating the invention, it is to be understood that various changes in detail and arrangement may be made without departing from the spirit and scope of this disclosure.

I claim:

1. A mooring system for securing a boat relative to four pilings while maintaining the boat centered relative to the four pilings, said system comprising:

a plurality of lines, one for each piling, each having a first end and a second end;

connecting means, one for each line, for connecting said first end of said each line to a corresponding portion of the boat;

hardware means, one for each piling, mounted directly on said each piling for receiving said each line extending from said boat, and for conveying said each line in a vertical downward direction from said hardware means; and counterweight means, one for each piling, connected to said second end of said each line and located vertically below said each hardware means for exerting a downward force on said each line;

wherein each said hardware means comprises a pulley mounted directly on said each piling for receiving said each line directly from the boat and for permitting said each line to move in either one of two directions under the combined influence of the downward force of said counterweight means and the movement of the boat relative to the four pilings;

wherein a portion of said each line extending from the boat to corresponding said hardware means forms an acute angle with a remaining portion of said each line extending from corresponding said hardware means to corresponding said counterweight means, whereby the boat is maintained centered relative to the four pilings.

2. The system of claim 1, wherein each said connecting means comprises a snap hook.

3. The system of claim 1, wherein each said hardware means further comprises a lag eye having a first end embedded in said each piling, said lag eye having a second end for securing said pulley to said lag eye at said each piling.

4. The system of claim 3, wherein each said hardware means further comprises a steel plate mountable to said each piling, said lag eye being mountable in said steel plate.

5. The system of claim 4, wherein said steel plate includes a coupling nut for receiving said first end of said lag eye.

6. The system of claim 4, wherein said steel plate is screw-mounted to said each piling.

7. The system of claim 3, wherein said hardware means further comprises a link connectable to said second end of said lag eye and to a portion of said pulley for securing said pulley to said lag eye at said each piling.

8. The system of claim 7, wherein said link comprises a quick link which releasably connects said pulley to said lag eye.

9. The system of claim 1, wherein each said pulley is mounted at a level higher than the level of the boat.

10. The system of claim 9, wherein said each line extends from the boat to said each pulley at an angle of substantially forty-five degrees relative to a horizontal direction.

11. The system of claim 1, wherein said each line extends in an upward direction from the boat to said each pulley.

12. The system of claim 11, wherein said each line extends from the boat to said each pulley at an angle of substantially forty-five degrees relative to a horizontal direction.

13. The system of claim 1, wherein the acute angle formed by the portion of said each line extending from the boat to corresponding said hardware means and the remaining portion of said each line extending from corresponding said hardware means to corresponding said counterweight means is substantially forty-five degrees.

14. A mooring system for securing a boat relative to a plurality of fixed points, comprising:

a plurality of lines, one for each fixed point, each having a first end and a second end;

connecting means, one for each line, for connecting said first end of said each line to a corresponding portion of the boat;

hardware means, one for each line, positioned at said each fixed point for receiving said each line extending from said boat, and for conveying said each line past said each fixed point and in a vertical downward direction from said each fixed point; and counterweight means, one for each line, connected to said second end of said each line and located vertically below said each fixed point for exerting a downward force on said each line;

wherein each said hardware means comprises a pulley located at said each fixed point for slidingly engaging said each line and permitting said each line to move in either one of two directions under the combined influence of the downward force of said counterweight means and the movement of the boat relative to the plurality of the fixed points;

wherein each said hardware means further comprises a lag eye having a first end mounted in a structure located at said each fixed point, said lag eye having a second end for securing said pulley to said lag eye at said each fixed point; and wherein said hardware means further comprises a link connectable to said second end of said lag eye and to a portion of said pulley for securing said pulley to said lag eye at said each fixed point; and wherein said second end of said lag eye is loop-like, and said link is loop-like.

15. The system of claim 14, wherein said portion of said pulley comprises a ring-like structure which is mutually engageable with said loop-like link of said hardware means.

* * * * *